US009296514B2

(12) United States Patent
Ficker

(10) Patent No.: US 9,296,514 B2
(45) Date of Patent: Mar. 29, 2016

(54) COLLAPSIBLE CONTAINER HAVING FOLDABLE SIDE AND END PANELS

(71) Applicant: BUCKHORN, INC., Milford, OH (US)

(72) Inventor: Paul J. Ficker, Cincinnati, OH (US)

(73) Assignee: BUCKHORN, INC., Milford, OH (US)

( * ) Notice: Subject to any disclaimer, the term of this patent is extended or adjusted under 35 U.S.C. 154(b) by 0 days.

(21) Appl. No.: 14/575,209

(22) Filed: Dec. 18, 2014

(65) Prior Publication Data

US 2015/0175304 A1 Jun. 25, 2015

Related U.S. Application Data

(60) Provisional application No. 61/919,500, filed on Dec. 20, 2013.

(51) Int. Cl.
*B65D 19/18* (2006.01)
*B65D 6/18* (2006.01)

(52) U.S. Cl.
CPC ..... *B65D 19/18* (2013.01); *B65D 11/1833* (2013.01); *B65D 2519/009* (2013.01); *B65D 2519/00034* (2013.01); *B65D 2519/00069* (2013.01); *B65D 2519/0096* (2013.01); *B65D 2519/00174* (2013.01); *B65D 2519/00208* (2013.01); *B65D 2519/00273* (2013.01); *B65D 2519/00288* (2013.01); *B65D 2519/00318* (2013.01); *B65D 2519/00338* (2013.01); *B65D 2519/00422* (2013.01); *B65D 2519/00502* (2013.01); *B65D 2519/00527* (2013.01); *B65D 2519/00562* (2013.01); *B65D 2519/00587* (2013.01); *B65D 2519/00611* (2013.01); *B65D 2519/00651* (2013.01); *B65D 2519/00711* (2013.01); *B65D 2519/00975* (2013.01)

(58) Field of Classification Search
CPC .... B65D 21/086; B65D 25/24; B65D 11/184; B65D 11/1833; B65D 11/186; B65D 11/18; B65D 43/0204; B65D 19/18
USPC ..... 220/4.29, 4.28, 7, 6, 628; 206/600, 386
See application file for complete search history.

(56) References Cited

U.S. PATENT DOCUMENTS

| | | | | |
|---|---|---|---|---|
| 3,941,271 | A * | 3/1976 | Zarges et al. | 220/6 |
| 4,591,065 | A * | 5/1986 | Foy | 220/7 |
| 4,674,647 | A * | 6/1987 | Gyenge et al. | 220/6 |
| 5,611,449 | A * | 3/1997 | Pedersen | 220/6 |
| 5,938,059 | A * | 8/1999 | Luburic | 220/6 |
| 6,820,761 | B1 * | 11/2004 | Mouri et al. | 220/6 |
| 6,902,061 | B1 * | 6/2005 | Elstone | 206/600 |
| 7,195,127 | B2 * | 3/2007 | Hsu et al. | 220/6 |

* cited by examiner

*Primary Examiner* — Robert J Hicks
(74) *Attorney, Agent, or Firm* — Mattingly & Malur, PC

(57) ABSTRACT

A collapsible container has a base with a bottom part having a bottom wall and feet and an upper part having side and end walls. Opposed side and end panels are hinged to the side and end walls of the base, respectively. The opposed side panels and opposed end panels are movable between an erected position and a folded position, in which one or both pairs of the opposed panels fold essentially flat onto the bottom wall of the base thereby reducing the height of the container for return shipment. Each of the opposed side panels of the container are hinged to the base at the same height in a channel formed in the corresponding side wall of the base to permit a hinge line to slide vertically in the channel formed in the side wall of the base.

19 Claims, 21 Drawing Sheets

COLLAPSIBLE CONTAINER HAVING FOLDABLE SIDE AND END PANELS

FIELD OF THE INVENTION

The invention relates to a collapsible container having a base with side and end panels movable between an erected position for containing goods and a collapsed position in which the panels fold onto the base thereby reducing the height of the container for return shipment.

DESCRIPTION OF RELATED ART

Collapsible containers having a base with side and end panels movable between an erected position for containing bulk product and a collapsed position of reduced height are known in the prior art. In U.S. Pat. No. 4,674,647, for example, the side and end walls are hinged to a pallet base and are movable between an erected position and a collapsed position. Since the end walls are of a height which is greater than half the distance across the bottom wall of the base, they overlap one another in the collapsed position. Further, since each of the end panels are hinged on a single axis hinge line to the base at the same height above the base bottom wall, the overlapping end walls remain angled upwardly and do not lie flat across the base in the folded position. This overlap causes the height of the container in the collapsed position to exceed a height requirement for stacking to enable efficient return shipment of the collapsed containers.

To solve the problem, a hinge structure is known for connecting the overlapping walls to the base that provides a double axis hinge line so that the overlapping walls or panels pivot about both axes and lie down essentially parallel or flat with the bottom wall of the base. As a result, neither of the overlapping panels or walls is angled upwardly when in the folded position. That is, the use of a double axis hinge in the connection of the overlapping walls or panels to the base, allows the panels to pivot at two different points above the bottom wall of the base in order to achieve the objective of permitting the overlapping panels to lie essentially parallel to the bottom wall of the base when folded. However, the double axis hinge joints are disadvantageous in that the hinge structure requires the molding of additional parts that are used to connect the overlapping panels to the base, which increases the manufacturing cost related to the molding of the parts for the containers, as well as associated assembly cost.

SUMMARY OF THE INVENTION

According to embodiments of the invention, a collapsible container is provided having a base with pairs of opposed side panels and opposed end panels movable between an erected position and a folded position, in which one or both pairs of the opposed panels fold essentially flat onto the base thereby reducing the height of the container for return shipment. The folded flat position is achieved with respect to the one or both pairs of the panels, which are connected to the base at the same height, without the requirement for a double axis hinge member connecting the panels to the base. As a result, the pairs of opposed side and end panels are able to be folded across the bottom wall of the container to achieve a desired height for return shipment of the collapsed container.

According to embodiments of the invention, the base of the container is dimensioned for handling as a standardized pallet. In some embodiments, the container has a lid which fits across the top of the container when pairs of opposed side and end panels are in the erected position, and also when the panels are in the folded position. Further, the lid permits stacking of one container on a like container in both the folded and erected positions.

In embodiments of the invention, one or both pairs of opposed side and end panels of the container are of a height sufficient to cause overlapping when the opposed panels are folded onto the bottom wall of the base. Each of the one or both pairs of opposed side and end panels of the container are hinged to the base at the same height in a channel or vertical slot formed in a corresponding side or end wall of the base. As a result, the hinge line slides vertically in the channel or slot formed in the corresponding side or end wall of the base. This permits the opposed ones of the side and/or end panels of the container to overlap one another, and thereby one or both pairs of opposed side and end panels lie essentially parallel to the bottom of the base.

DETAILED DESCRIPTION OF THE DRAWINGS

Figure 1:
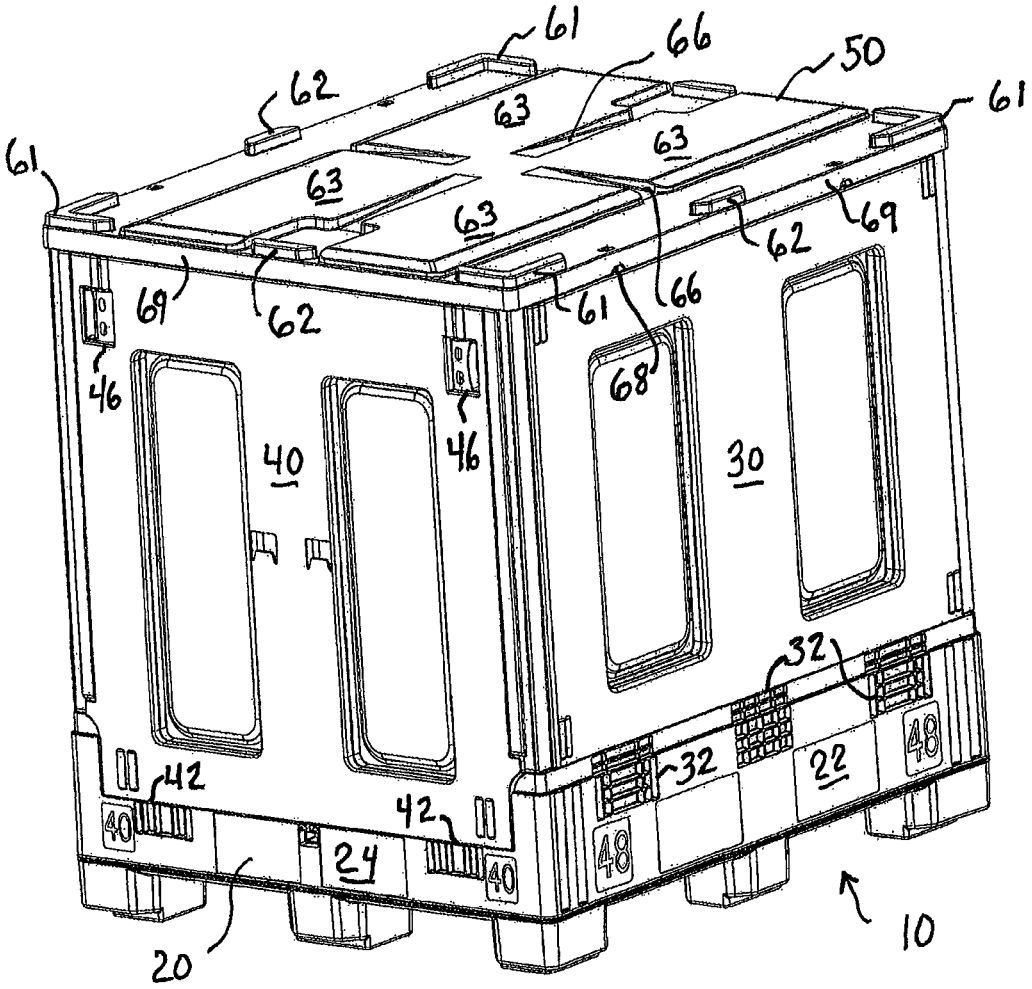
FIG. 1 is a perspective view of an embodiment of a collapsible container in an erected configuration and covered with the lid.

FIG. 1 shows a container 10 according to an embodiment of the invention. The container includes a pallet type base 20 having opposed base side walls 22 and opposed base end walls 24. The container is shown in the erected position in FIG. 1 with opposed container side panels 30 connected through sliding hinge joints to base side walls 22 and opposed container end panels 40 connected through fixed hinge joints to the base end walls 24 of the base 20. A lid 50 is provided to optionally cover the enclosed area of the container 10.

Figure 2:
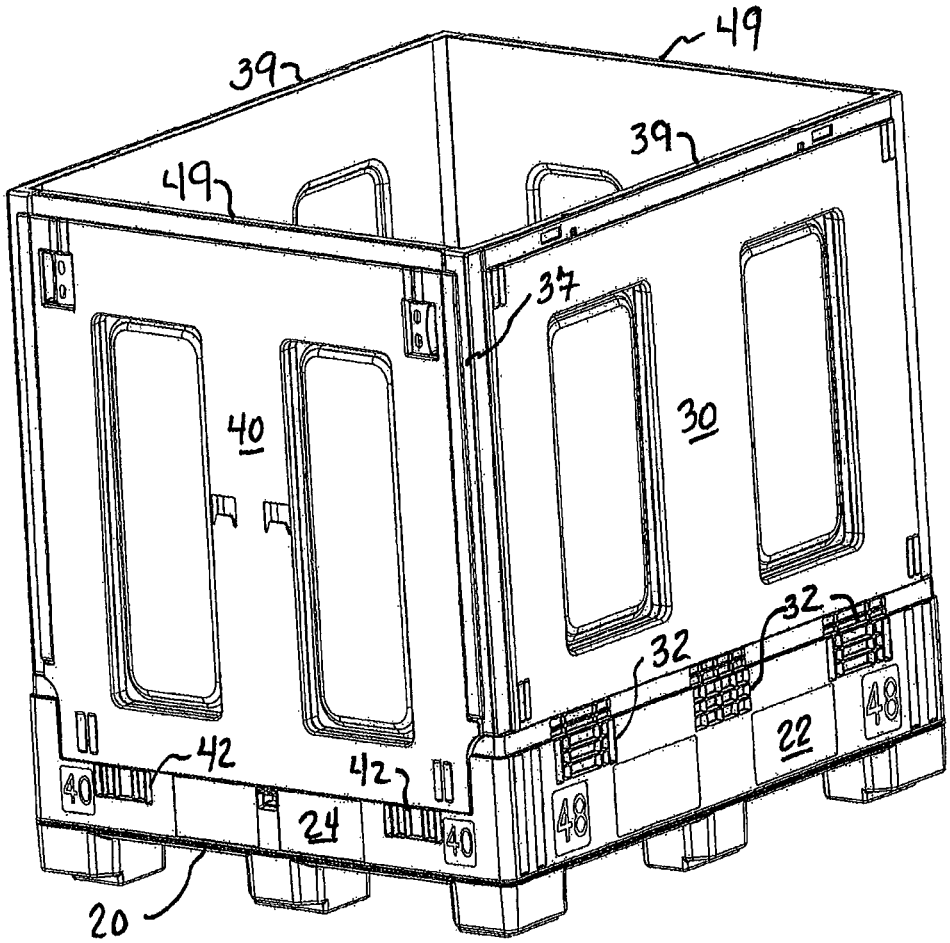
FIG. 2 is a perspective view of the collapsible container of FIG. 1 with the lid removed.

FIG. 2 shows the container of FIG. 1 without the lid 50. In the erected position shown in FIGS. 1 and 2, like containers 10 are able to be stacked on each other. As shown in FIG. 1, features of the lid 50 enable the lid of a lower container 10 to support the base of an upper container when the containers are in the erected position and stacked on top of one another.

Figure 4A:
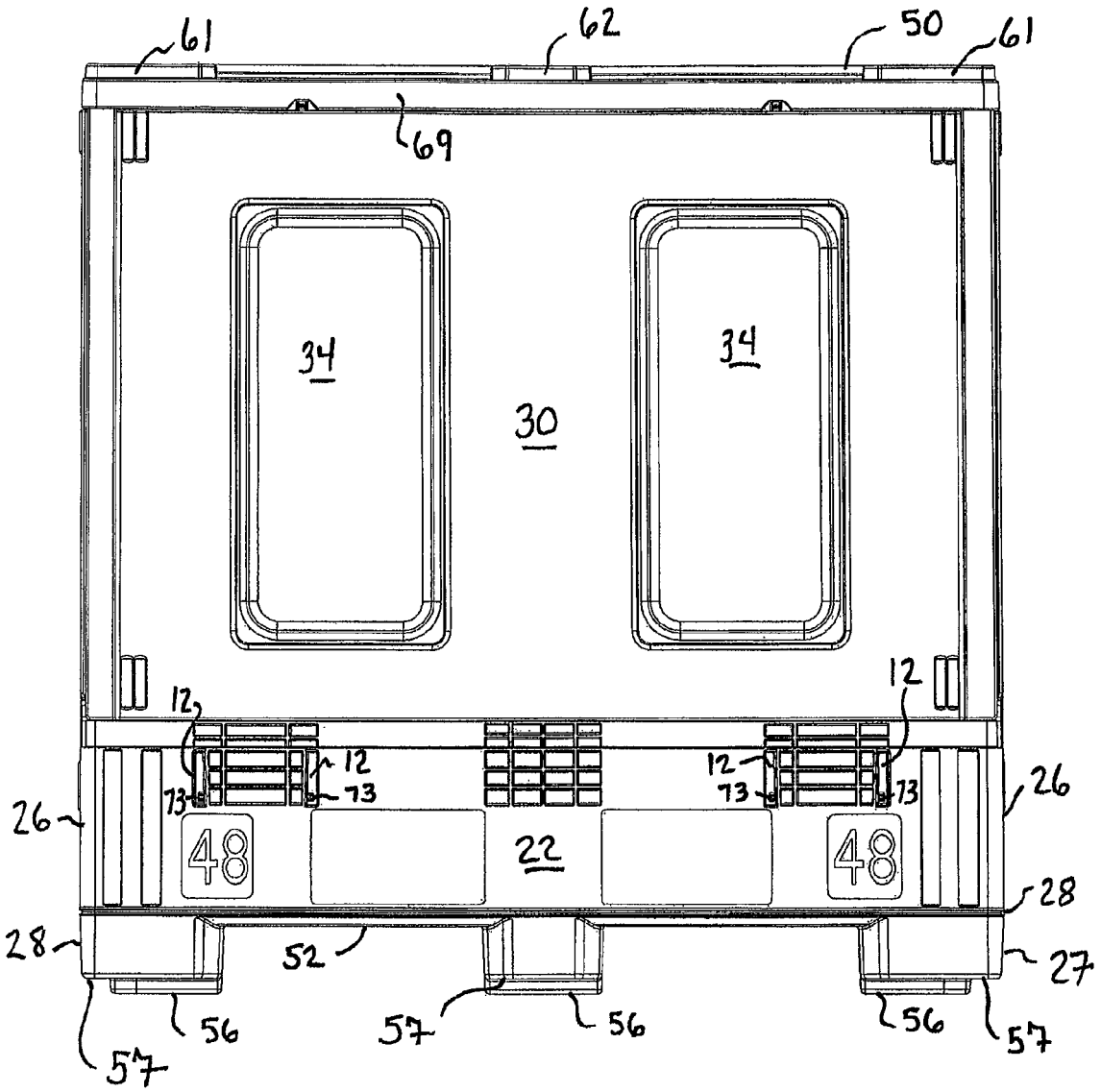
FIG. 4A is a side elevational view of the container with the lid shown in FIG. 1.
Figure 4B:
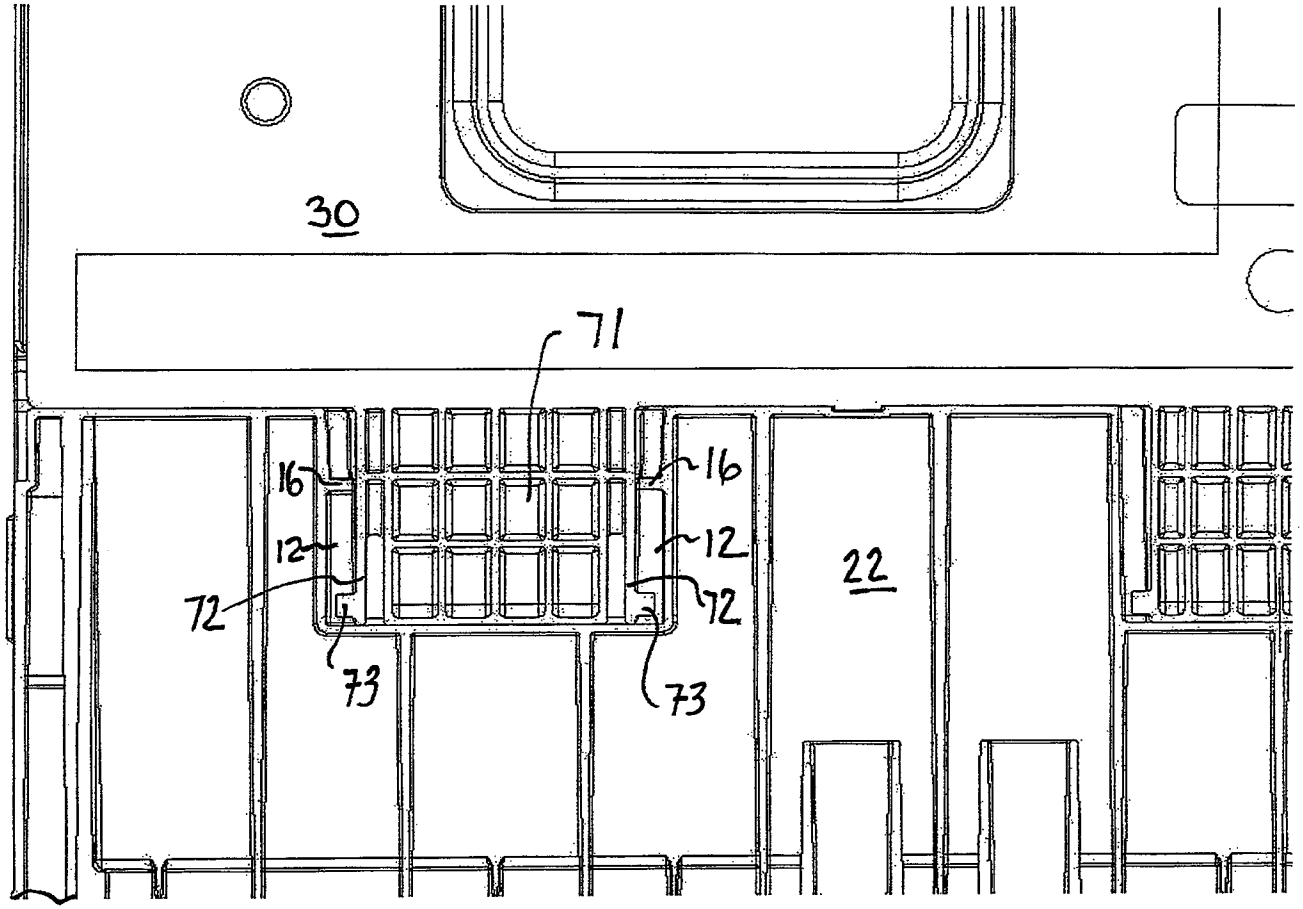
FIG. 4B is a detailed view of a portion of the container shown in FIG. 4A.
Figure 5:
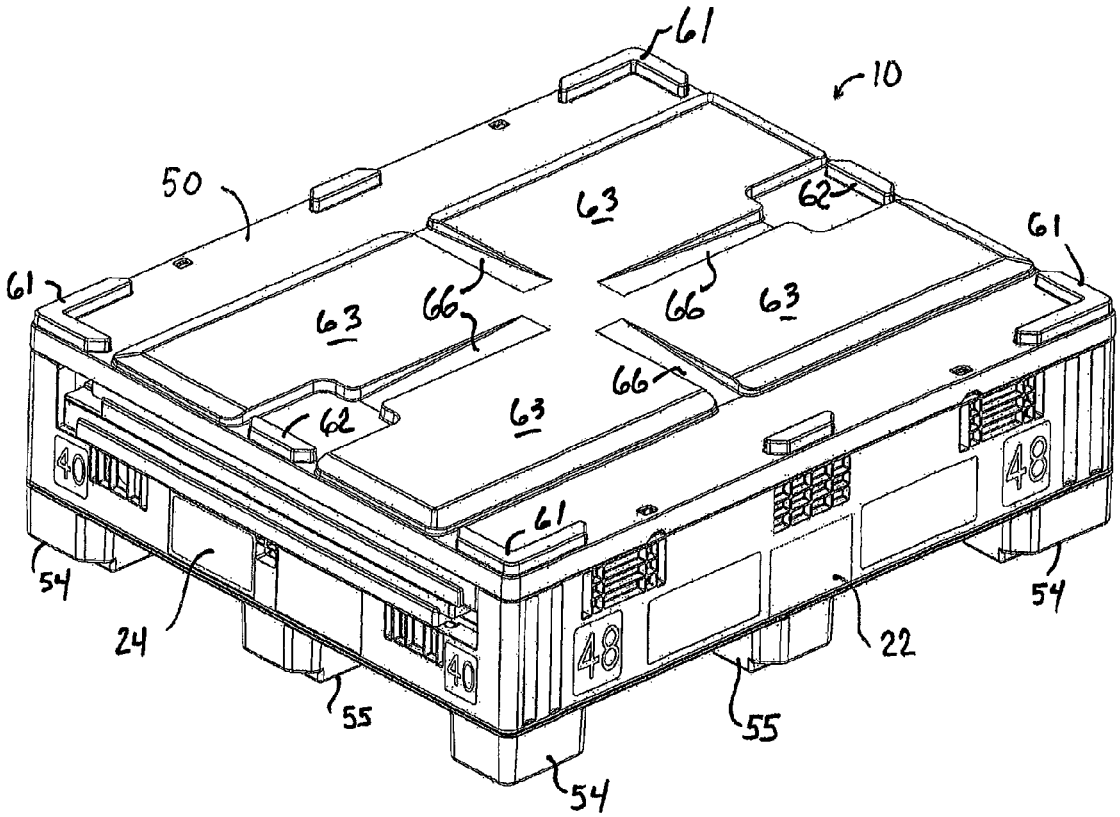
FIG. 5 is a perspective view of the container shown in FIG. 1 in the collapsed position with the lid.
Figure 6:
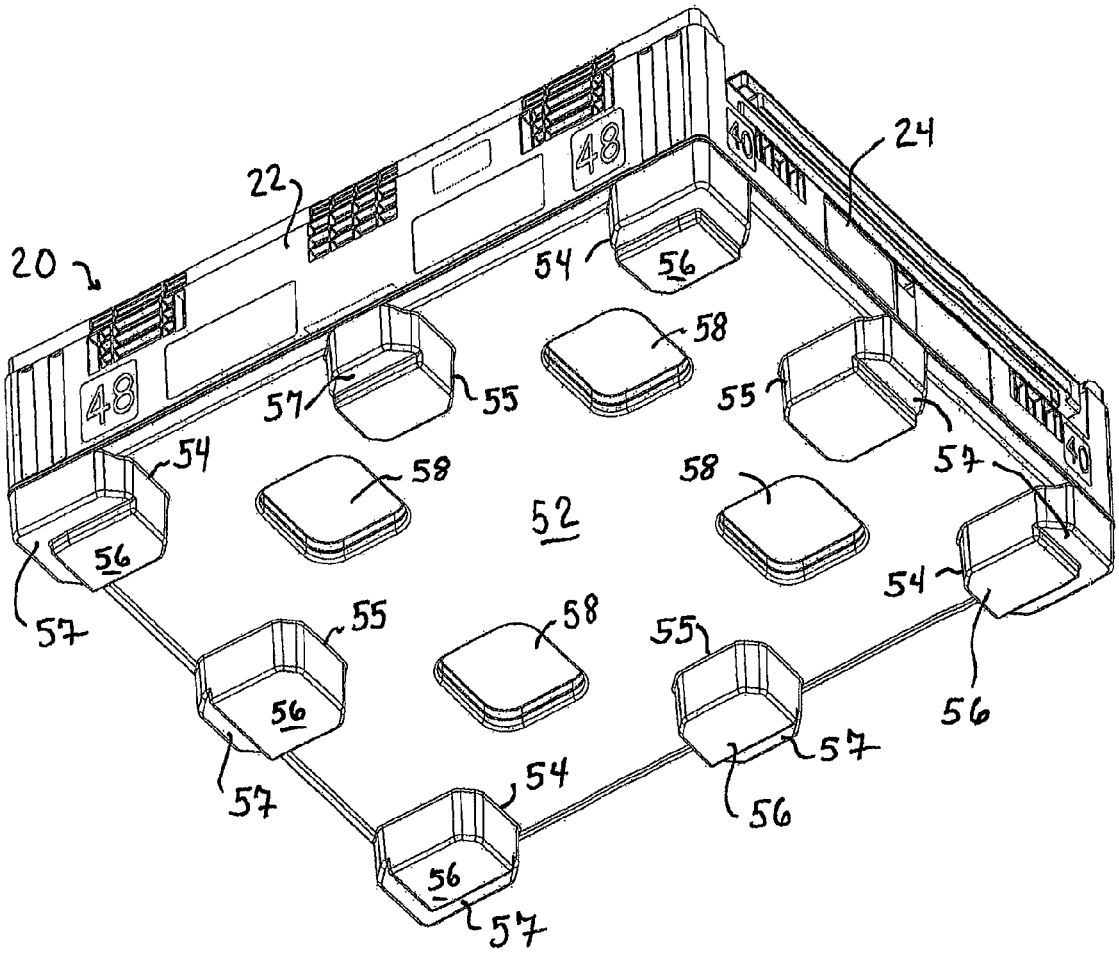
FIG. 6 is a bottom perspective view of the container shown in FIG. 1 without the lid.

The base 20 of the container is shown in FIGS. 1-5, and also in perspective view from underneath in FIG. 6. Base 20 has a two part molded construction that is welded together including an upper base part 26 and a lower base part 27 as shown in FIGS. 3A and 4A. FIG. 6 shows an underneath side of a generally flat bottom wall 52 of the base 20. The bottom wall 52 and the structure below a weld line 28 are molded as the lower base part 27. The structure of the upper base part 26, which is above weld line 28, is molded separately and joined to the base lower part 27 using conventional hot plate welding, for example.

In an embodiment of the invention, the lower base part 27 is stack molded to have a double skin structure, the bottom skin being shown in FIG. 6 as the part of bottom wall 52. The double skin structure is fused together along the facing ribs and peripheral or edge flanges to form a hollow space between the skins to reduce overall weight of the structure. The joining of the ribs and edges between the skins in this configuration enables strengthening of the base parts. Further, by providing ribs and edges facing inwardly between the double skin structures, the outer surfaces are essentially smooth walled. In a stack molding configuration, the plastic is injected using areas 58 which are between the upper and lower skins. The double skin structure is fused together in areas 58, and these areas are surrounded by the double wall structure which is hollow as a result of the spacing between the outer and inner walls. The stack molded structure also provides for a double wall structure in the corner and middle feet 54, 55 with an appropriate spacing in the hollow area.

The upper base part 26 is injection molded according to an embodiment of the invention and the area between the upper base part 26 and lower base part 27 is welded for joining the parts together.

The lower base part 27 includes the corner feet 54 at the corners of the base 20 and the middle feet 55 which are located between corner feet 54. Each of the corner and middle feet has a foot pad 56 that supports the base 20 on a flat horizontal surface or on an adjacent container when similar containers are stacked atop each other. A spacing between adjacent feet 54, 55 is sufficient to enable forklift entry and handling of the container 10 in accordance with standard container handling specifications.

For stacking of one container 10 upon another container 10, whether the containers are in the erected position or the collapsed position, the corner and middle feet 54, 55 of the base 20 of one container are able to be stacked on top of the lid 50 of an adjacent container 10. In this regard, the corner posts and middle feet 54, 55, respectively have foot portions 57 which engage upstanding flanges at the corners and mid portions of the lid 61, 62 for interengagement of the feet 54, 55 of a base 20 of one (upper) container 10 with the upstanding flanges 61, 62 of the lid 50 of an adjacent (lower) container 10 for stacking stability. Additionally, the lid 50 has four centrally disposed raised portions 63 that engage the end and side wall portions of the feet 54, 55 when stacked on the lid 50 of an adjacent container. Also, as shown in FIG. 1, the lid has channels 66 sloping away from a raised center portion of the lid between the four centrally disposed raised portions 63. Further, a security tie feature 68 is provided in the lid 50 which is aligned to cooperate with the side panels 30.

Figure 3A:
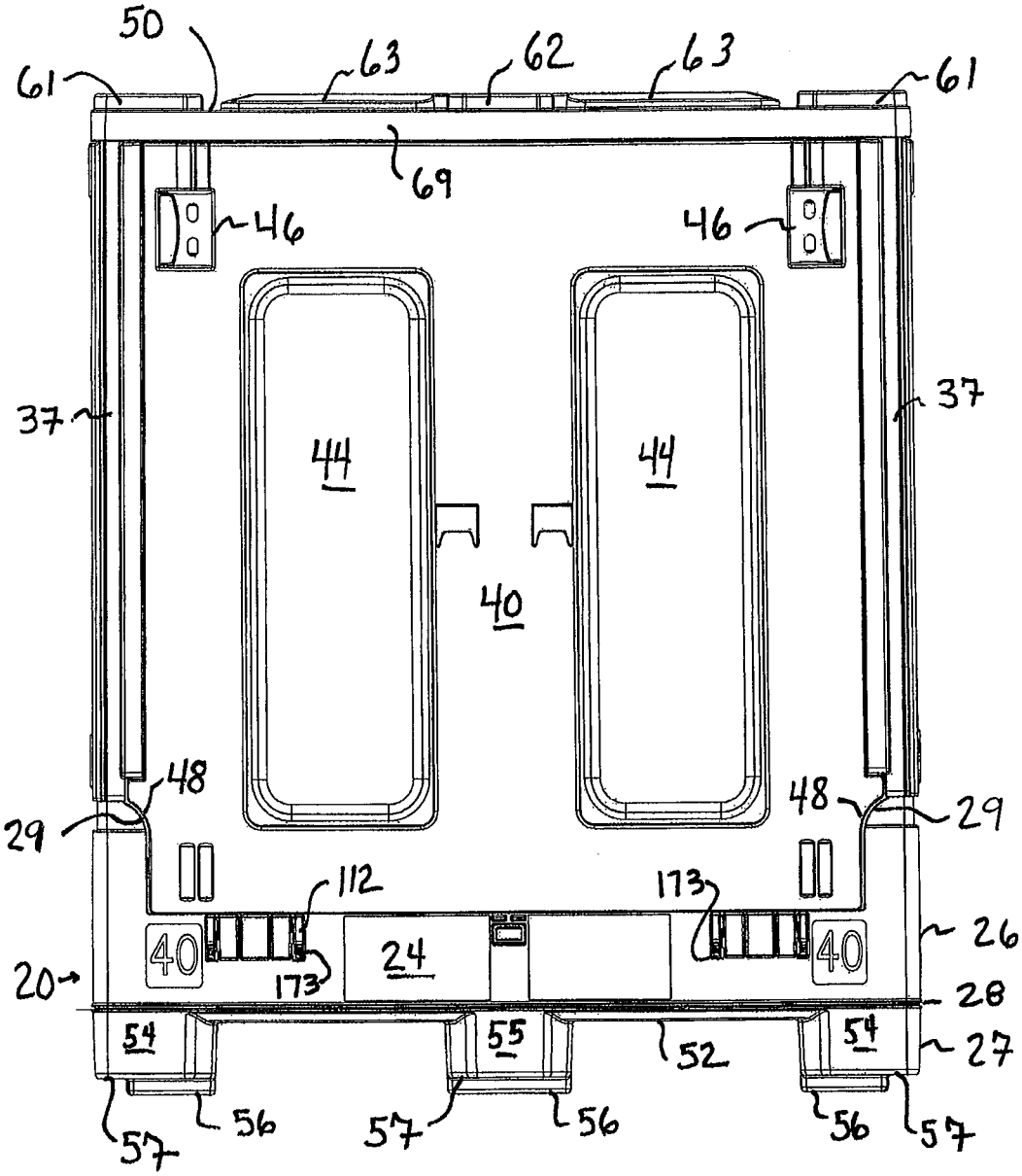
FIG. 3A is an end elevational view of the container with the lid in the erected position shown in FIG. 1.
Figure 3B:
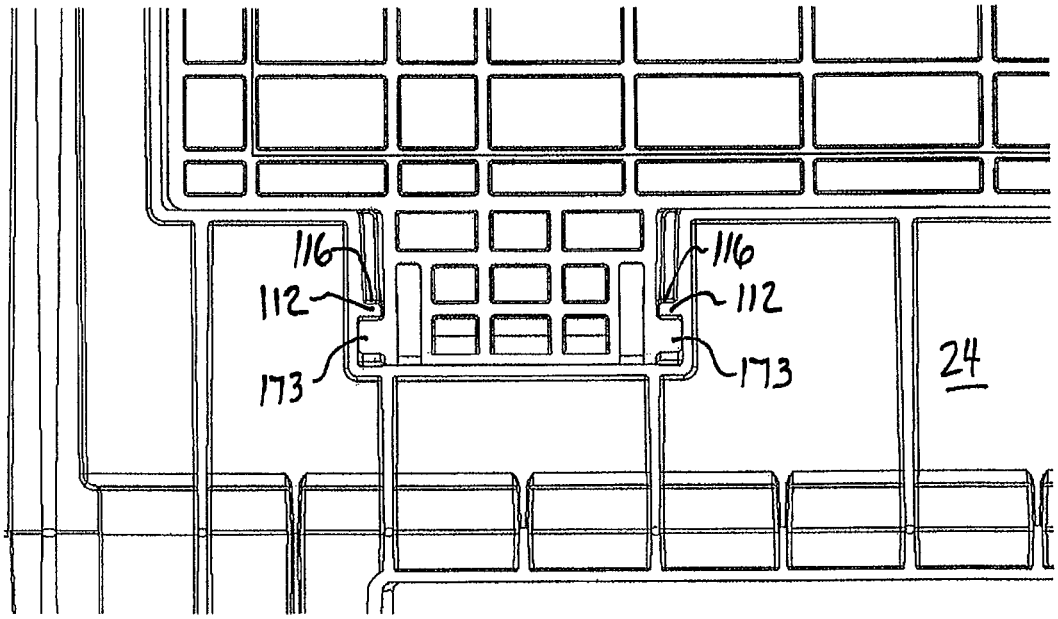
FIG. 3B is a detailed view of a portion of FIG. 3A.
Figure 12A:
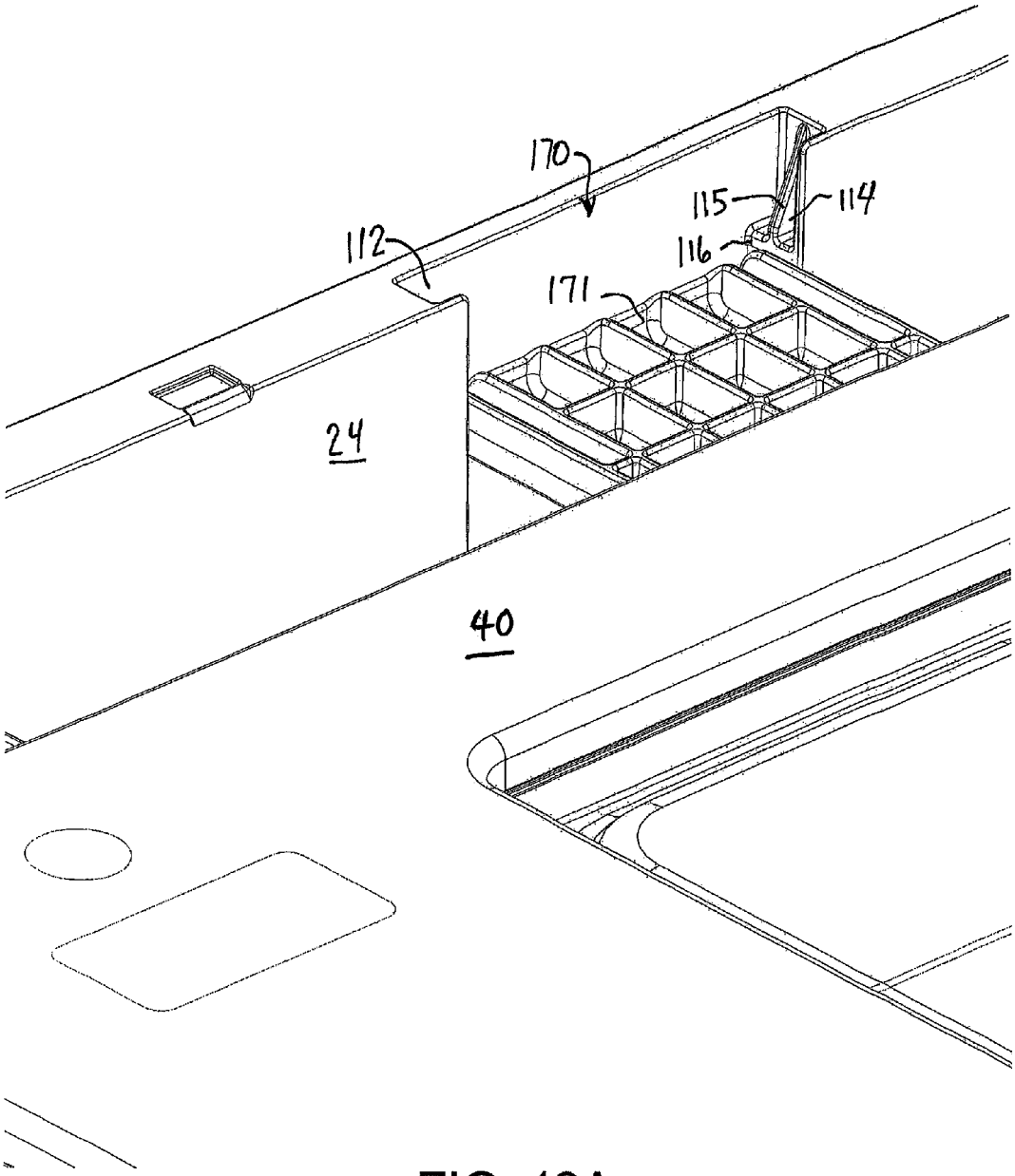
FIG. 12A is a partial perspective view of the base and one end wall of the container shown in FIG. 1 in the collapsed position.
Figure 12B:
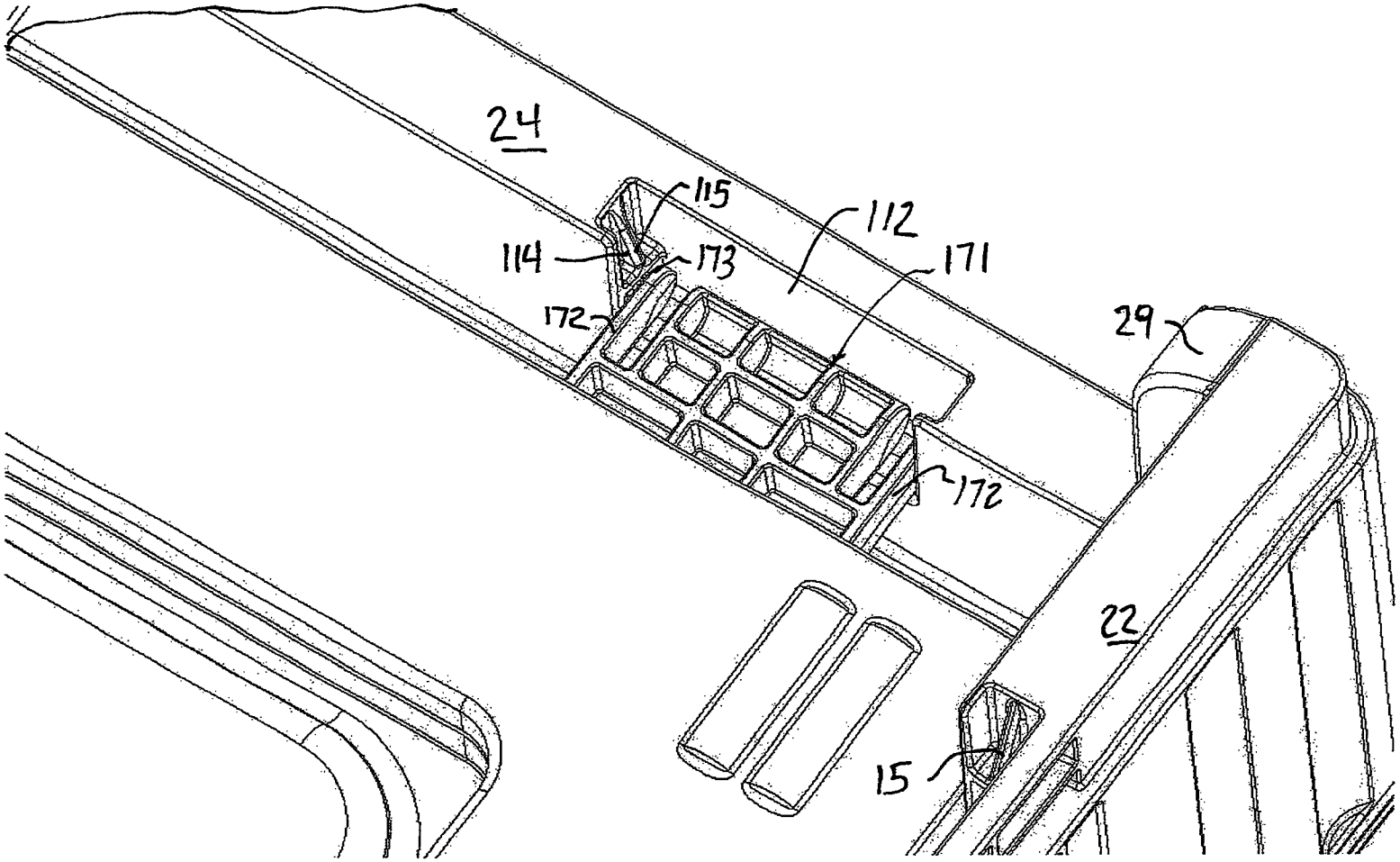
FIG. 12B is a detailed partial view of the base and one end wall of the container shown in FIG. 1 in the collapsed position.

FIGS. 3A and 4A show the end elevation view and side elevation view of the container 10 with lid 50. As shown in FIGS. 3A and 3B, the end panels 40 are connected to be hinged to base 20 through hinge joints generally indicated at 42 in FIG. 1, and which will be explained in greater detail with respect to FIGS. 12A and 12B.

End panels 40, according to one embodiment of the invention, are stack molded in two parts that are joined (fused or welded) together along inwardly facing ribs and edges to provide a lightweight structurally sound panel that is smooth walled on the external surfaces. In end panel areas 44, in which the plastic is injection molded into the stacked molds, a double wall thickness area is formed. Surrounding these end panel areas 44, the double wall structure is spaced apart and the hollow structure provides weight reduction while the double skin structure provides strength. Side panels 30 are similarly constructed from injection molding using stacked molds.

Latches 46 are provided at the upper corners of the end panels 40 for joining the side edges 47 of the end panels 40 to the corner return flanges 37 of the side panels 30 to be explained in greater detail with reference to FIGS. 13A, 13B, 13C and 14. At the lower portion of end panels 40 are curved lower wall portions 48 that match similarly curved portions 29 of end walls 24 of base 20 in the upright position. As a result, the curved portions 48 of the end panels are supported by the curved portions 29 of the end walls 24 of the base 20 in the erected position.

FIG. 2 shows the container 10 without the lid in which an upper edge 49 of the end panel 40 is contiguous with upper edge 39 of the side panels 30 when the panels are in an erected position. The lid 50 has a lid flange 69 extending about the periphery of the lid 50 and that overhangs the upper edges 39 and 49 of side and end panels 30 and 40, respectively, as shown in FIG. 1.

As shown in FIG. 4A, the side panels 30 have side panel areas 34 that are similar to the areas 44 of the end panels 40 and that result from the stacked molding of the side panels 30. Additionally, FIG. 4A shows that the side panels 30 are connected through hinge joints generally indicated by 32 to the side walls 22 of the base 20, which will be explained in greater detail with reference to FIGS. 11A-11C.

Figure 13A:
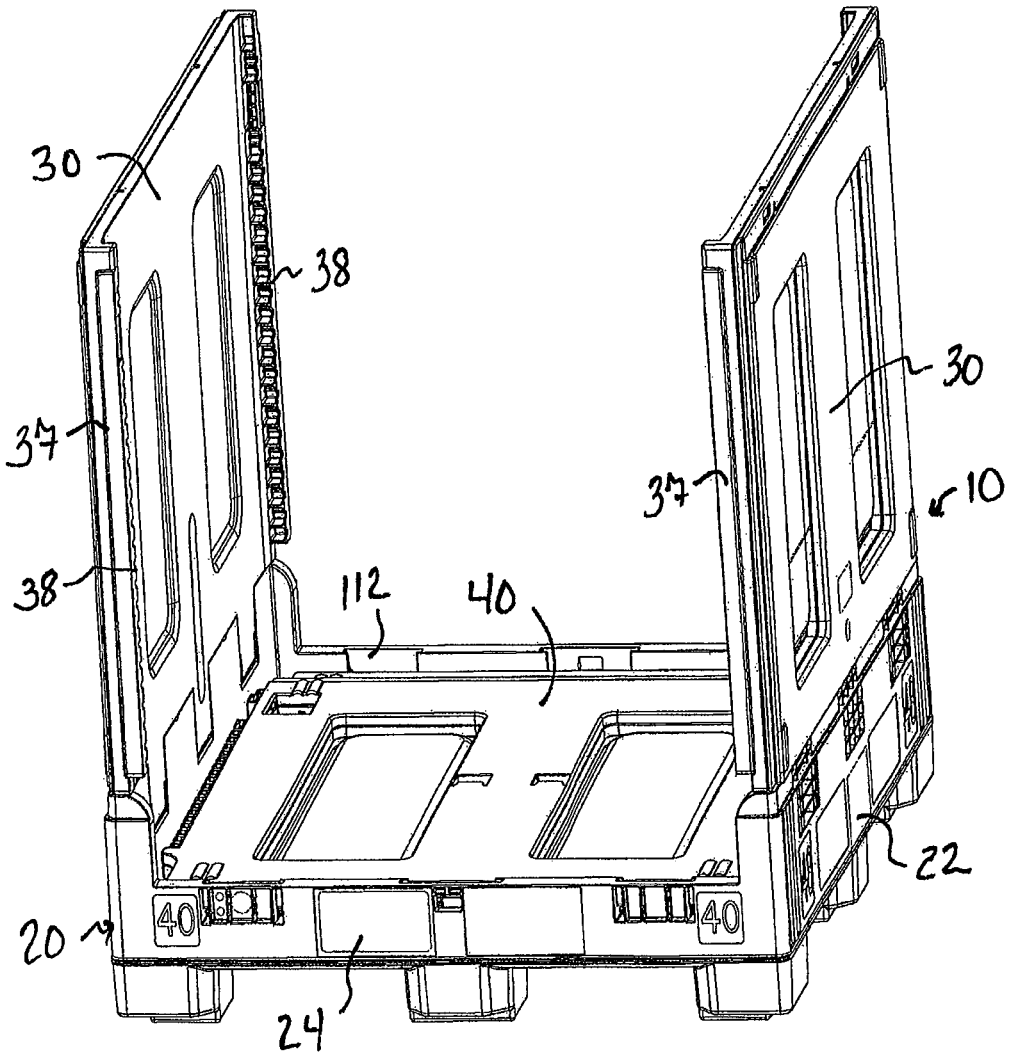
FIG. 13A is a perspective view of the container shown in FIG. 1 without the lid that shows the end walls in the collapsed position and the side walls in the erected position.
Figure 13B:
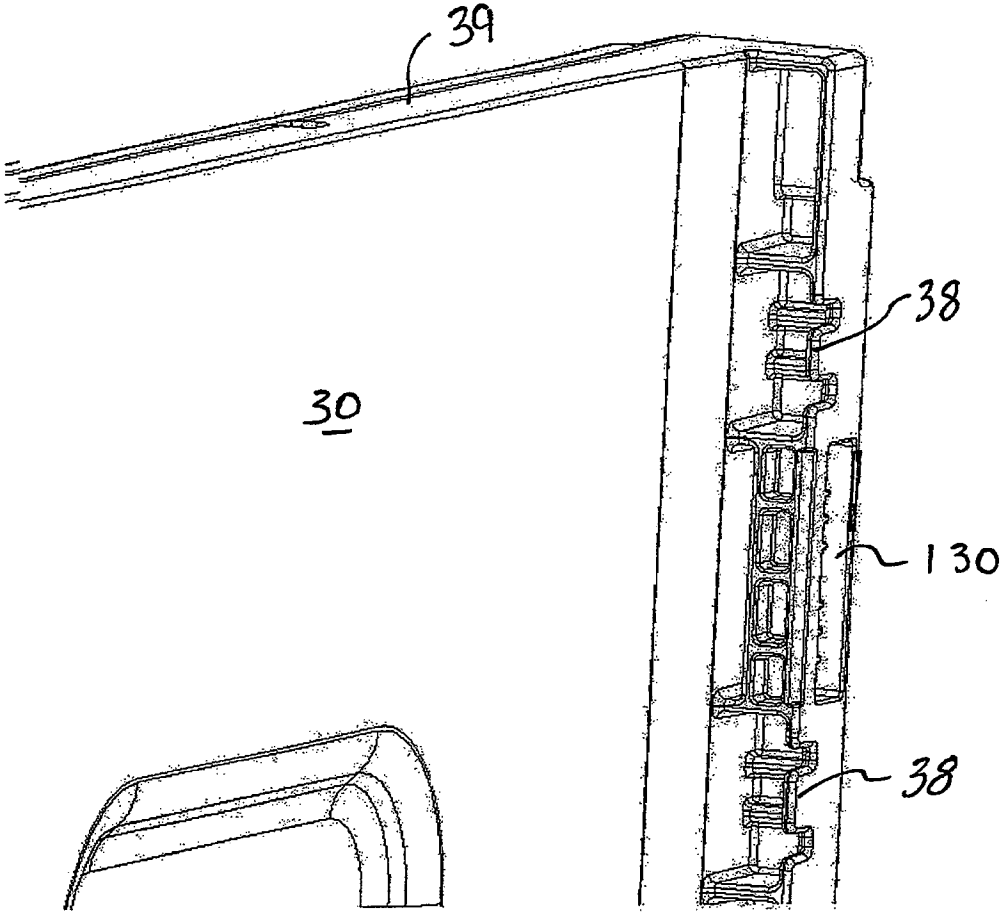
FIG. 13B is a detailed partial view of a corner of a side wall of the container shown in FIG. 1 without the lid.
Figure 13C:
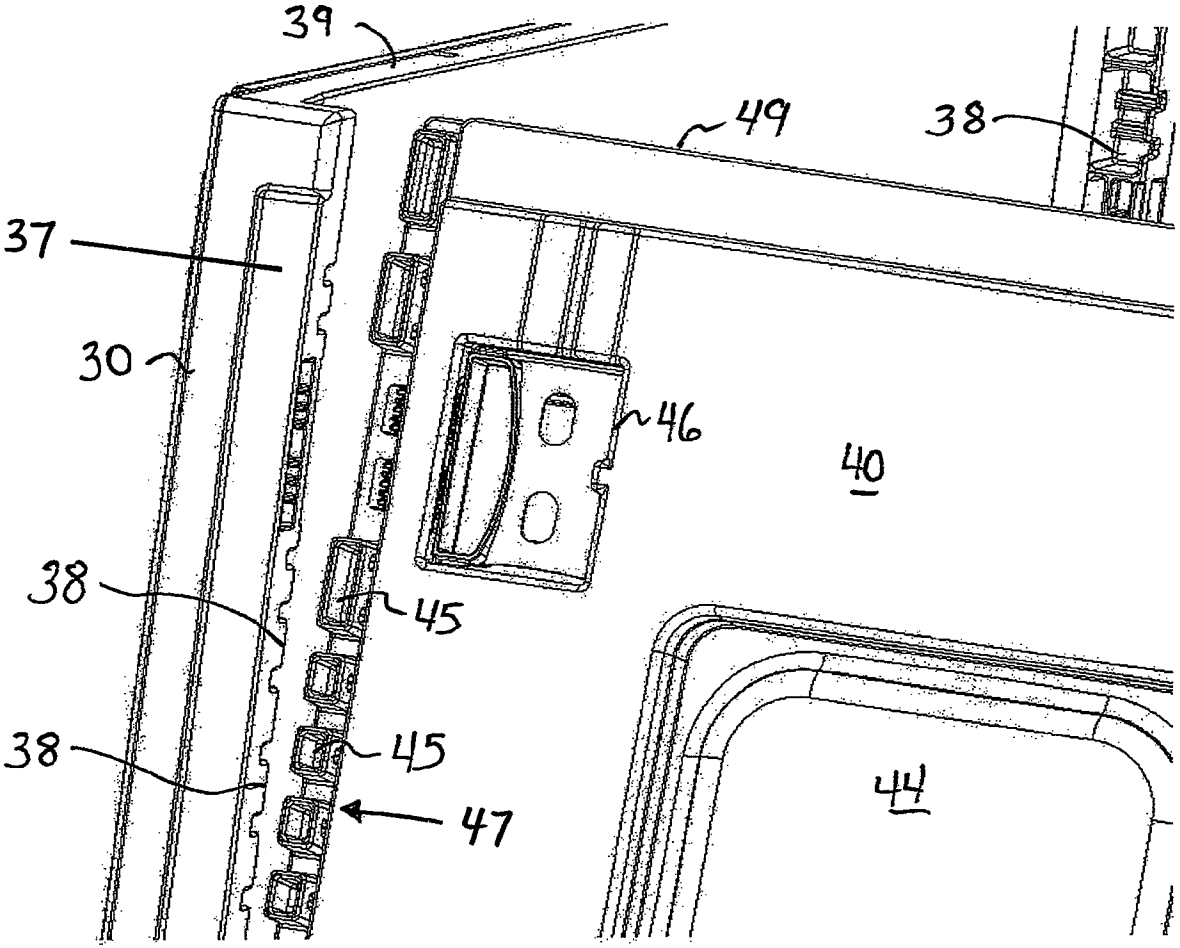
FIG. 13C is a detailed partial view of a corner of a side wall of the container shown in FIG. 1 without the lid.

When the side panels are pivoted upwardly into the erected position, shown in FIG. 13A, the corner return flanges 37 are in a position adapted to receive the side edges 47 of the end panels 40 when the end panels 40 are thereafter lifted into the erected position. In detail, the return flanges 37 have tab and groove structures 38 (shown in detail in FIGS. 13B and 13C). The side edges 47 of the end panels 40 have corresponding tab and groove structures 45 that interengage with the tab and groove structures 38 to form the corner joints of the container in the erected positions, as shown in FIGS. 1 and 2. The end panel latches 46, which are shown in detail in FIG. 13C, are provided on the end panels and are configured to be inserted into in a latch finger pocket 130 formed in curved return flange 37 of side panel 30.

The container 10 is adapted to hold various goods, including bulk product, for example, when in the erected position shown in FIGS. 1-4B. When empty, the side and end panels are collapsible wherein the side and end panels 30, 40 are folded down into the base 20 onto a top wall thereof, to achieve a collapsed configuration as shown generally FIGS. 5-9.

Figure 14:
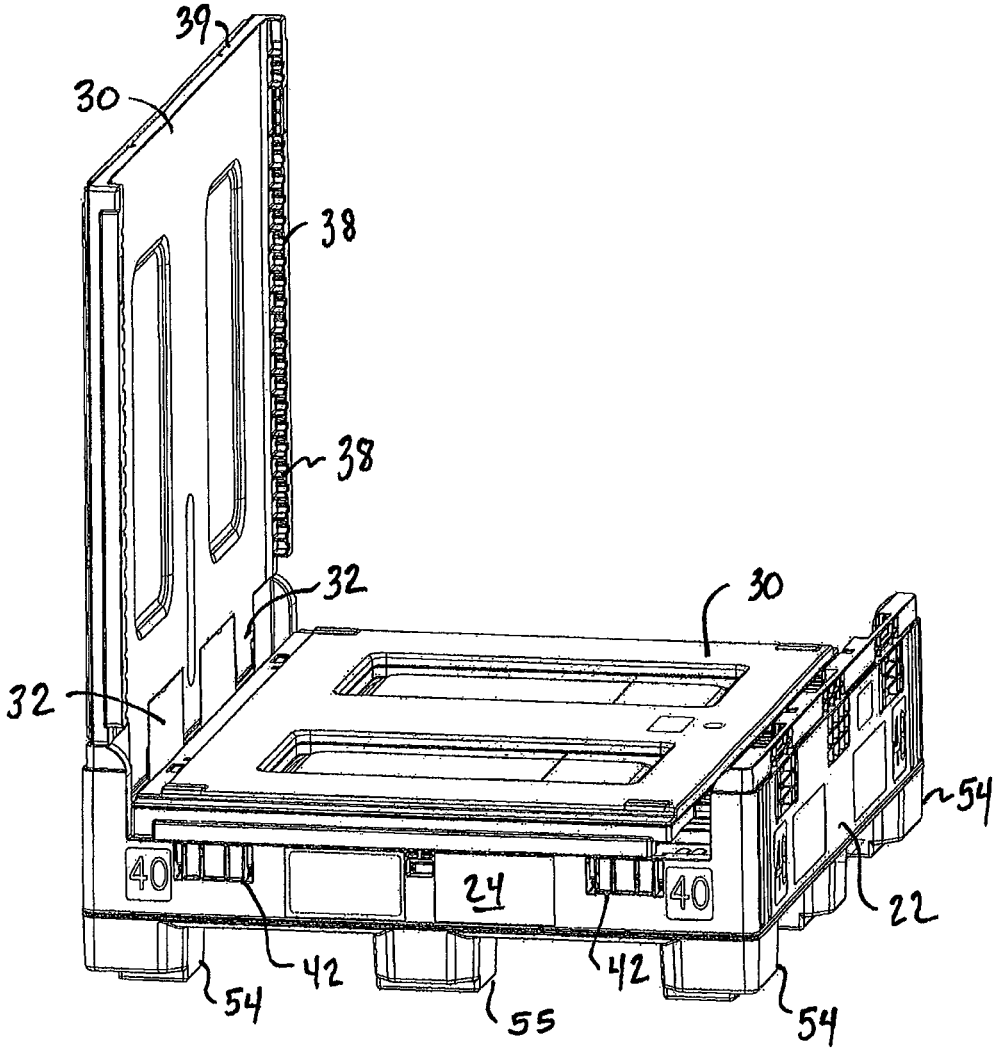
FIG. 14 is a perspective view similar to FIG. 13 in which one of the end walls is shown in the collapsed position and one of the end walls is shown in the erected position.

As shown in FIG. 5, in the collapsed position, the end and side panels 40, 30, respectively, are folded to lie substantially flat or generally in parallel with the bottom wall 52 of the base 20. FIG. 13A shows the end panels 40 folded into the collapsed position onto the top wall of the base 20. FIG. 14 shows a first of the side panels 30 being folded down on top of the end panels 40. Either end panel 40 can be folded first because the hinge line of the end panels 40 is lower than the hinge line for the side panels 30. Further, the folding of the side panels 30 can be performed in any order to achieve the collapsed configuration.

In the collapsed configuration, the lid 50 is adapted to be fit over the top of the base 20 as shown in FIGS. 5 and 7-9. In particular, along an upper portion of the side walls 22 of the base is a shoulder flange forming a relief area that accommodates the lid flange 69 of the lid 50 for structurally supporting the lid 50 on the base 20 in the collapsed configuration of the container 10.

Figure 7:
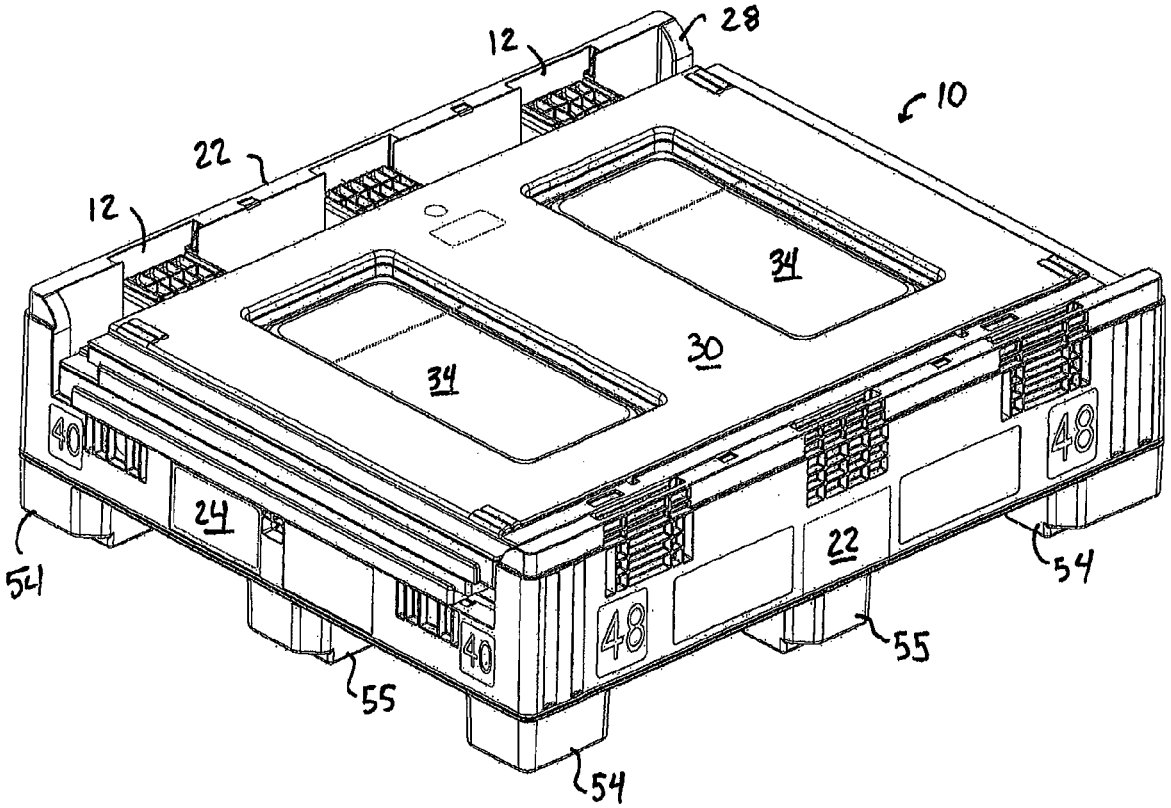
FIG. 7 is a perspective view of the container without the lid in the collapsed position shown in FIG. 6.
Figure 8:
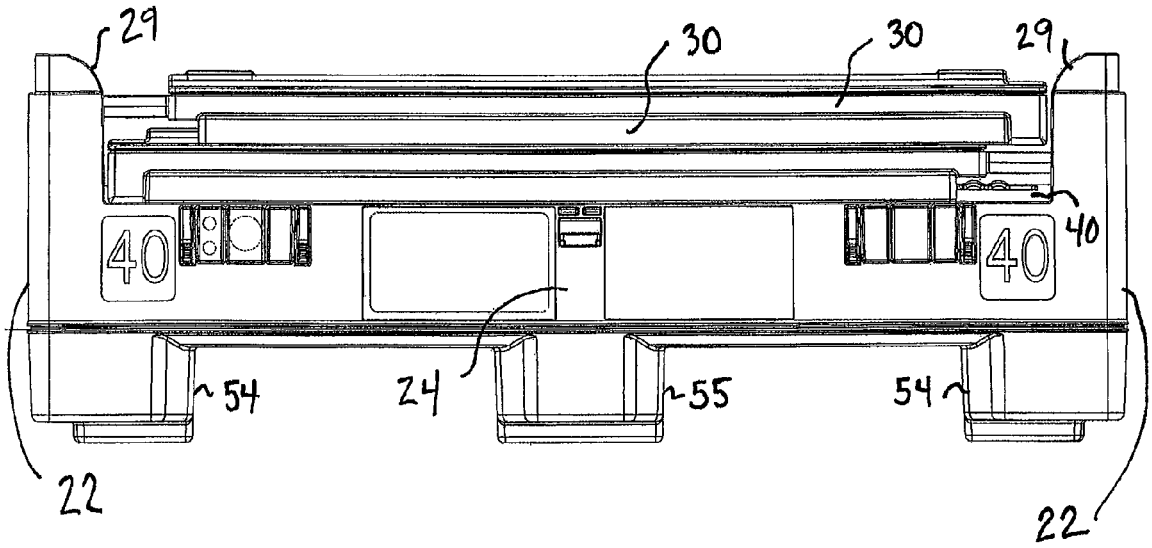
FIG. 8 is an end elevational view of the container in the collapsed position shown in FIG. 7.
Figure 9:
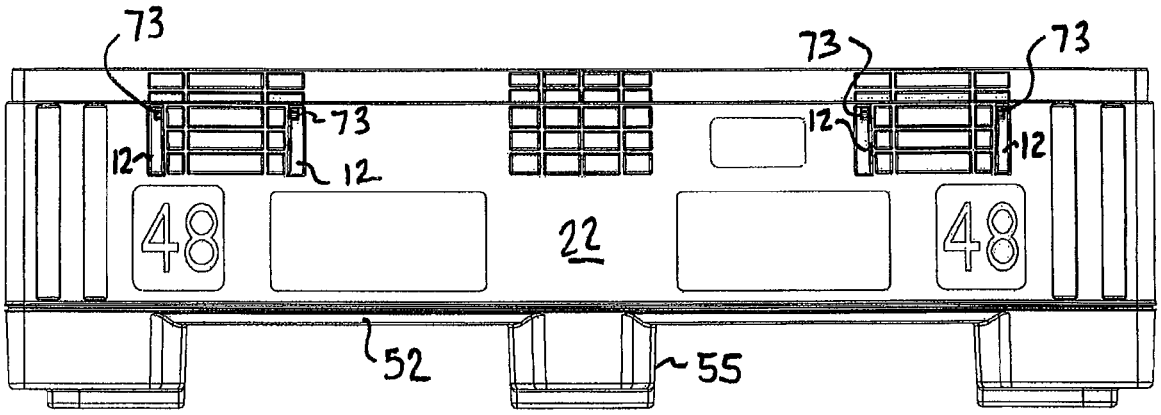
FIG. 9 is a side elevational view of the container in the collapsed position shown in FIG. 7.
Figure 10:
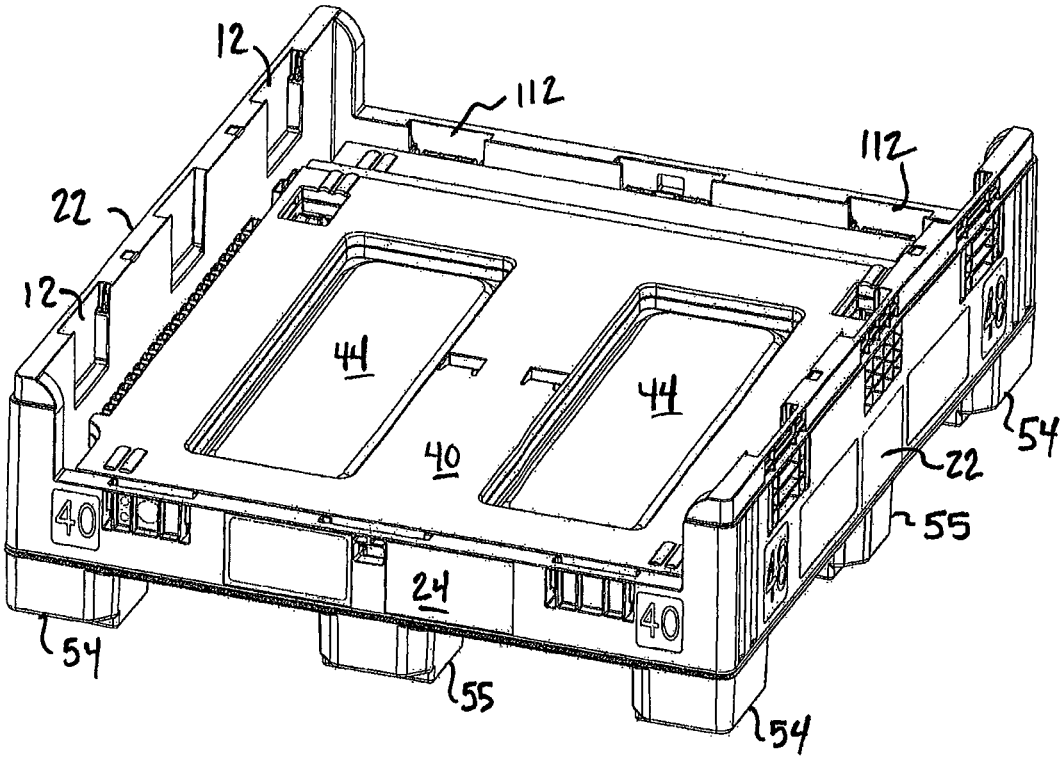
FIG. 10 is a perspective view of the container of FIG. 1 in the collapsed position of FIG. 7 shown without the side walls.

FIG. 7 shows a perspective view of the container in the collapsed configuration with the side and end panels folded flat and parallel to the bottom wall 52 of base 20 and without lid 50 being placed atop the base 20. FIG. 8 shows an end view and elevation view of the container in the collapsed configuration without the lid 50. Side panels 30 are shown in overlapped position on top of end panels 40. FIG. 9 shows the container in side elevation view in the collapsed configuration without the lid 50. FIG. 10 shows the container in end elevation view in which only the end panels 40 are shown hinged to the base 20 for purposes of illustration.

The side and end panels 30, 40 are hinged to side and end walls 22, 24 of base 20 through side panel and end panel hinge joints 32 and 42, respectively, generally shown in FIGS. 1-4B. With reference to FIGS. 11A-11C and FIGS. 12A-12B, the hinge joints 32, 42 are shown in greater detail. End panels 40 each have two hinge joints 42 in connection with the base end wall 24 and side panels 30 have three hinge joints 32 in connection with the base side wall 22 as shown. However, in an embodiment of the invention, the hinge joint connections between the base and panel are different in that the hinge joints 32 provide a sliding hinge for the side panels 30, whereas the hinge joints 42 provide a fixed hinge joint for the end panels 40.

Figure 11A:
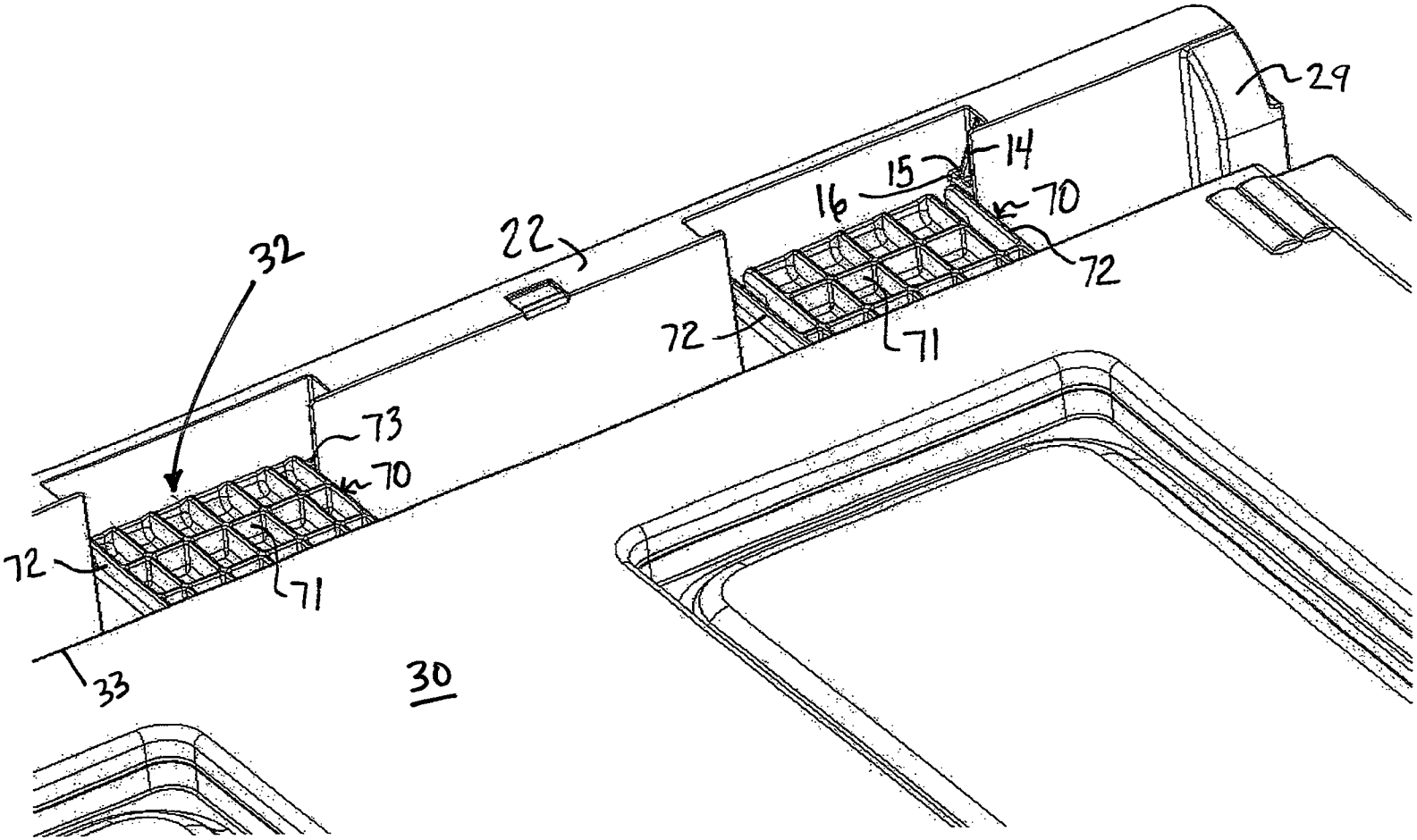
FIG. 11A is a partial view of the container shown in FIG. 1 in the collapsed position.
Figure 11B:
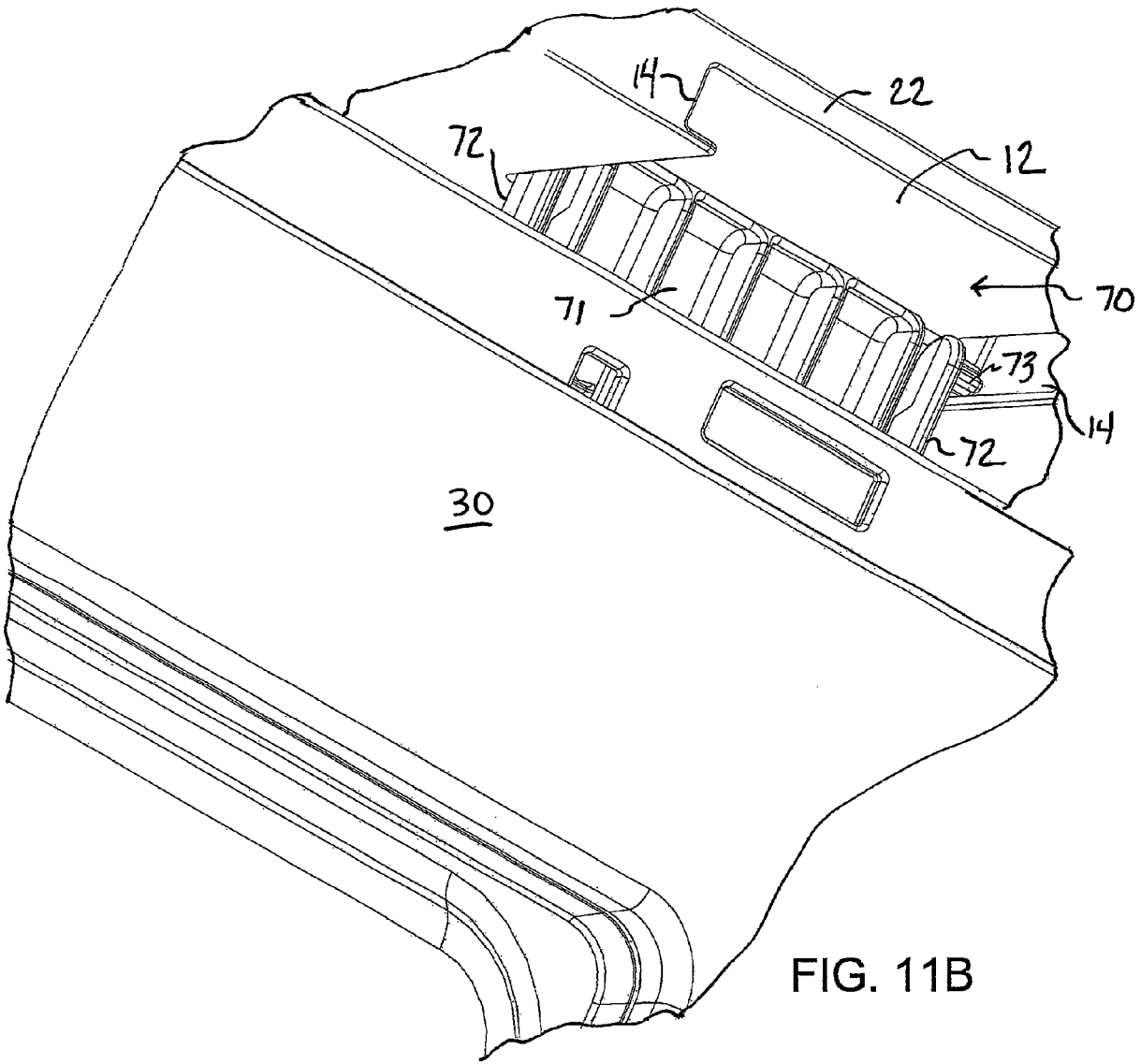
FIG. 11B is a partial view of the container shown in FIG. 1 in the collapsed position.
Figure 11C:
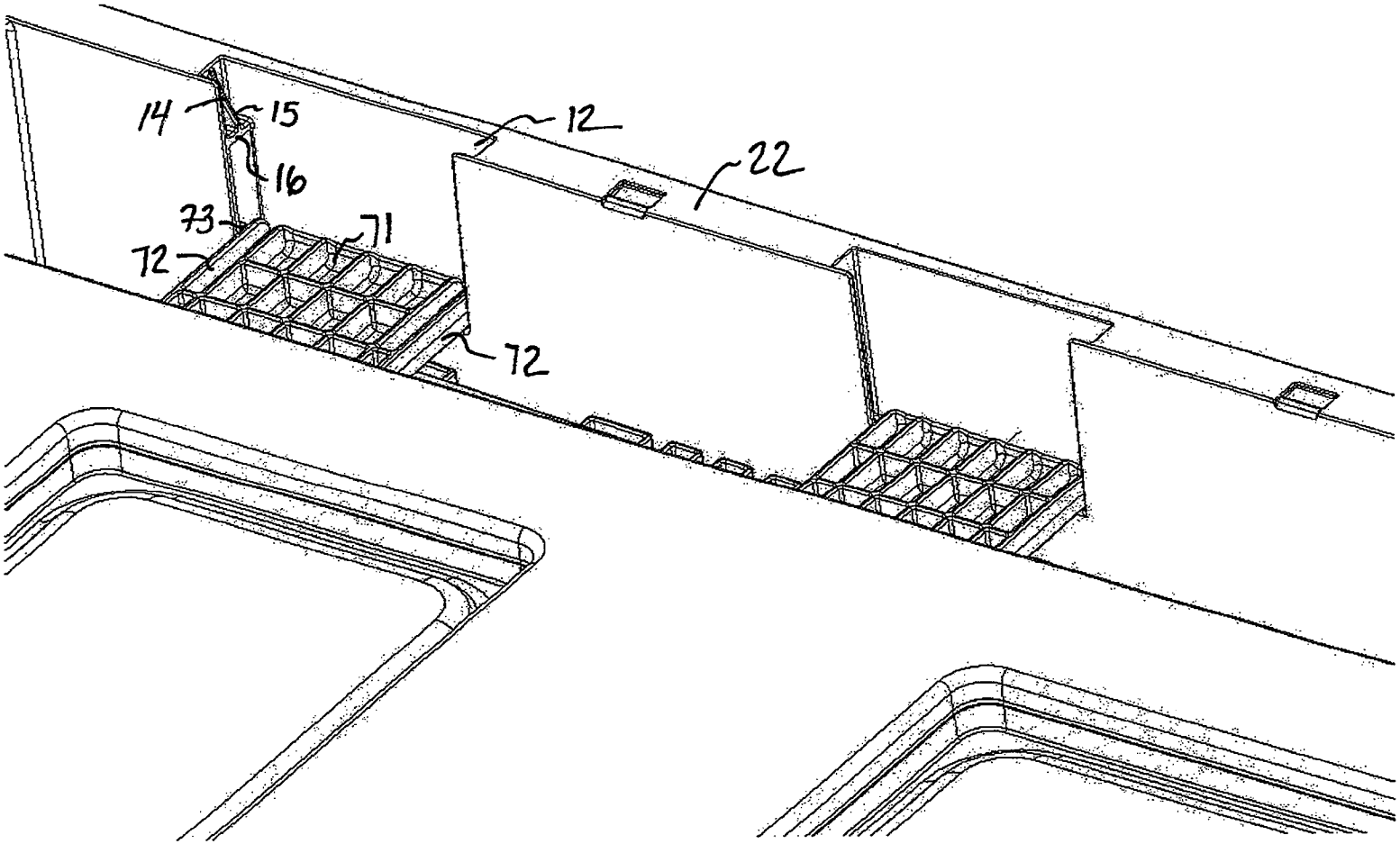
FIG. 11C is a detailed partial view of the container shown in FIG. 1 in the collapsed position.

As shown in FIGS. 11A-11C, at the bottom of the side panel 30 is a hinge structure 70 for a side panel hinge joint 32 and comprised of reinforcing ribs 71 extending between opposing outer hinge pin flanges 72. Each of the outer hinge pin flanges 72 has a cantilever support at one end which is integral with a bottom edge 33 of the side panel 30 and a hinge pin 73 protruding laterally outwardly, one of which is shown in FIG. 11B and partially shown in FIG. 11C. A gap between the hinge pin flange 72 and the grid of reinforcing ribs 71 permits inward lateral movement of the hinge pin flange 72 when the hinges are connected between the side panel 30 and the base 20.

FIGS. 11A-11C show the base side wall 22 of the side of the base 20 having a channel 12 which receives the hinge structure 70 of each of the side panels 30. FIG. 10 also shows the channels 12 since the side panels 30 are shown removed from the container 10 in FIG. 10. Opposing sides 14 of the channel 12 each include a triangular shaped flange extending downwardly into the channel and forming a ramp or sloped surface 15 seen in FIGS. 11A and 11C, and supported at its terminus by a horizontal flange 16. In assembly, hinge pin flanges 72 on opposite sides of the hinge structure 70 are pushed downwardly into channel 12 such that the hinge pins 73 engage the sloping surface 15 of the triangular flange to resiliently inwardly deflect the hinge pin flanges 72 to allow the hinge pins 73 to move past the horizontal flange 16, thereby locking the hinge structure 70 into the channel 12. As a result, the hinge structure 70 is captured by the channel 12 and the hinge pins 73 are free to move up and down within the channel between the horizontal flange 16 and a bottom wall of the channel 12.

The hinge structure 70 between the side panels 30 and side walls 22 of the base 10 permit the side panels 30 to have a pivot or hinge axis that slides up and down within the channel 12. In the side elevation view shown in FIG. 4A, and in the detail view shown in FIG. 4B, the partial cutaway of the left and right sections of the base side wall 22 reveals the channel 12 in the base 10, and in which the pins 73 are shown to be located. As shown, the pins 73 are disposed at the bottom or lower portion of the channel 12 when the side panels are in the erected position. On the other hand, as shown in the collapsed position of the side panel 30, as depicted in FIG. 9, the hinge pins 72 slide upwardly within the channel 12, above the position shown in the erected configuration of FIG. 4B, in order to permit the side panels 30 to lay substantially flat against the lower, adjacent end panels 40.

For a hinge structure 170 between the end panels 40 and the end walls 24 of the base 10, the hinge axis is fixed within the channel. FIGS. 3A, 3B, 12A and 12B show a channel 112 formed in the base end wall 24 and that includes opposing sides 114 which each include a triangular shaped flange extending downwardly into the channel 112 and forming a ramp or sloped surface 115 supported at its terminus by a horizontal flange 116, together with reinforcing ribs 171 extending between opposed outer hinge pin flanges 172. The base end wall horizontal flange 116 is positioned deeper into channel 112 than the comparable horizontal flange 16 in channel 12 shown in the base wall 22 and which supports the hinge structure 70 of the side panels shown in FIGS. 11A-11C. Accordingly, in assembly of the end panels 40 to the base 20, the hinge flanges 172 on opposite sides of the hinge structure 170 are pushed downwardly into channel 112 such that hinge pins 173 engage the sloping surfaces of the triangular flanges 115 formed by the sides 114 of the channel 112 to resiliently inwardly deflect the hinge pin flanges 172 and to allow the hinge pins 173 to move past the horizontal flanges 116 and to become seated in the bottom of the channel 112. As a result, the hinge pins 173 of the end panels 30 are locked into the position as shown in FIG. 8, for example, at the bottom of the channel 112, which is also shown in detail in FIGS. 12A and 12B.

FIGS. 13A and 14 show the container of FIG. 1 in a position intermediate between being fully collapsed and an erected position. In particular, in FIG. 13A the end panels 40 are folded inwardly into the base 20 and the side panels 30 are shown in the erected position. The end panels 40 lay folded onto the base and parallel to the base bottom wall 52. The side panels 30, such as the one depicted in FIG. 14, lay flat on the end panels 40 and are not angled substantially upwardly due to the vertical movement permitted by the hinge pins 73 within the channels 12 in the base wall 22. FIGS. 7 and 8 show the compact folded positioning of the side and end panels in the collapsed position.

FIG. 14 shows the partially collapsed/partially erected configuration of the container 10 in which each of the end panels 40 has been folded onto the base 20 and one of the side panels 30 remains upright. An end panel 40 is erected after both side panels 30 are in the erected position as shown in FIG. 13A. This provides stability at the corner joints formed between the end panels 40 and the side panels 30 when the end panels 40 are erected into position which end panel and side panel erection causes engagement of the tab and groove structures 38 along the corner return flange 37 of the side panels 30 with the cooperative tab and groove structure 45 of the end panels 40.

The corner return flanges 37 are in a position to receive the side edges 47 of the end panels. The corner return flanges 37 have tab and groove structures 38 and the side edges of the end panels have corresponding tab and groove structures 45 that interengage each other to form the corner joints of the container. Additionally, the latch finger pocket 130 is provided in each of the corner return flanges 37 of the side panels 30 and as shown in FIG. 13C, receives the latch 46 which enters the corresponding latch finger pocket 130 once the end panels 40 are raised into position in which the tab and groove structures 38 and 45 along the edges interengage one another. The latch finger pocket 130 has protruding flanges which are resiliently biased outwardly and have sloped faces that enable the latch 46 to be easily inserted into the latch finger pocket 130 when the end panels 40 are raised into the upright position, and if necessary the resilient force can be counteracted by pulling back on a handle of each latch 46 to ensure entry of the protruding flanges into the latch finger pocket 130 when the container 10 is in the erected position.

By providing the end panels 40 with a fixed hinge structure, in which the hinge pins 173 are restricted from moving vertically within the channel 112 by the horizontal flange 116, the interengagement of the corner return flanges 37 of the side panels 30 and the side edges 47 of the end panels lock the hinge joint 32 of the side panels 30 to prevent up and down movement thereof when the container 10 is in the erected position. As a result, the hinge structure 170 of the side panels 30 does not require a pocket or recess in which the bottom edges of the side panels 30 rest to lock the side panels 30 in an upright position. Rather, the side panels 30, when in an upright position, have abutting surfaces that abut to each side of the hinge structures 70. As shown in FIGS. 4A and 4B, the hinge pins 73 are at the bottom of the channel 12 formed in the base side wall 22 and therefore the hinge pins 73 are able to allow for upward vertical movement of the side panels 30 when the side panels 30 are upright. However, the engagement of the side panels with the end panels 40 at the corner joints prevents such upward movement and locks the side panels into the upright position when the container is in the erected position.

Numerous other modifications and adaptations of the present invention will be apparent to those skilled in the art and thus, it is intended by the following claims to cover all such modifications and adaptations which fall within the true spirit and scope of the invention.

I claim:

1. A collapsible container, comprising:

a base having a bottom wall, base side walls and base end walls;

a pair of opposed side panels and a pair of opposed end panels respectively hinged to the base side and end walls;

wherein each of the pair of opposed side panels and the pair of opposed end panels is movable between an erected position and a folded position, and in said folded position, a first of the pairs of opposed side panels and end panels fold essentially flat parallel to the bottom wall of the base and a second of the pairs of opposed side panels and end panels fold essentially flat onto the first of the pairs of opposed side and end panels to minimize a height of the container in the folded position, wherein one of the first and second pairs of opposed side and end panels of the container are each fixedly hinged to a respective one of the side and end walls of the base to permit folding of the one pair of opposed side and end panels onto the base, wherein the base has channels formed in ones of the side and end walls of the base corresponding to the second one of the first and second opposed pairs of side and end panels of the container and wherein each of the second of the pairs of opposed side panels and end panels has hinge portions to be received within the respective channels in the ones of the side and end walls of the base to permit a hinge line to slide vertically in the channels permitting, in the folded position, folding of the second of the first and second opposed pairs of the side and end panels onto the one of the folded first and second pairs of opposed side and end panels, each of said channels including spaced channel ends defined by sloped channel end surfaces and a horizontal flange, and wherein each of first ones of the first and second opposed pairs of side and end panels of the container has side edge return flanges with grooves and each of second ones of the first and second opposed pair of side and end panels has side edge tabs that are received in corresponding ones of the grooves of the adjacent opposed ones of the first and second opposed side and end panels in said erected position of said collapsible container, whereby, when said pairs of opposed side panels and end panels are in said erected position, said second ones of said first and second opposed pairs of side and end panels are fixed to said first ones of said first and second opposed pairs of side and end panels to lock all of said panels to said base.

2. The collapsible container of claim 1 further including upper edges of said pair of opposed side panels and said pair of opposed wall panels, and a container lid positionable on said upper edges when said collapsible container is in said erected position.

3. The collapsible container of claim 1 further including latches on ones of said first and second pairs of opposed side panels and end panels and cooperating latch finger pockets on the other of said first and second pairs of opposed side panels and end panels.

4. The collapsible container of claim 1 further including spaced hinge pins on each said side panel and end panel, said hinge pins being receivable in a channel space beneath said horizontal flanges.

5. The collapsible container of claim 4 wherein each said channel space is sized to permit said hinge pins to slide vertically.

6. The collapsible container of claim 4 wherein said hinge pins are located on outer hinge pin flanges located on a lower portion of each of said side panels and base panels.

7. The collapsible container of claim 6 wherein said sloped channel end surfaces deflect said outer hinge pin flanges when said hinge portions are received within said channels.

8. The collapsible container of claim 2 wherein said base bottom wall includes a plurality of base feet.

9. The collapsible container of claim 8 wherein each of said base feet includes a base foot portion.

10. The collapsible container of claim 9 wherein said container lid includes a container lid top having upstanding container lid top flanges, said upstanding container lid top flanges being configured to receive said base foot portions of a second collapsible container placed atop said container lid of a lower collapsible container.

11. The collapsible container of claim 10 further including base corner feet and base middle feet, each having said base foot portions.

12. The collapsible container of claim 1 further including curved lower wall portions of said base and shaped curved lower wall portions of said ones of said first and second opposed pairs of side and end panels, said curved lower wall portions of said base and said curved lower wall portions of said first and second opposed pairs of side and end panels being in engagement when said ones of said first and second opposed pairs of side and end panels are in said erected position of said collapsible container.

13. The collapsible container of claim 1 wherein ones of said first and second opposed pairs of said side and end panels include curved return flanges engageable with side edges of the other of said first and second opposed pairs of said side and end panels.

14. The collapsible container of claim 13 wherein said curved return flanges are located on said second ones of said first and second opposed pairs of said side and end panels having said vertically slidable hinge line.

15. The collapsible container of claim 1 wherein said base includes a lower base part having said bottom wall and an upper base part, said lower base part and said upper base part being joined together along a weld line.

16. The collapsible container of claim 2 wherein said base side walls have base side wall upper shoulder flanges forming a relief area adapted to receive said container lid when said pair of opposed side panels and said pair of opposed end panels are in said folded position.

17. The collapsible container of claim 16 wherein said container lid includes a lid flange engageable with said upper shoulder flanges.

18. The collapsible container of claim 2 wherein said container lid includes a security tie feature.

19. The collapsible container of claim 1 wherein said side panels and end panels are stack molded in two parts that are joined together.

* * * * *